US009206777B2

(12) United States Patent
Simons et al.

(10) Patent No.: US 9,206,777 B2
(45) Date of Patent: Dec. 8, 2015

(54) FUEL SYSTEM CONVERSIONS FOR CARBURETOR TO ELECTRONIC FUEL INJECTION SYSTEMS, METHODS OF PRODUCTION THEREOF

(71) Applicants: Robert Samuel Simons, Redondo Beach, CA (US); Chadron Michael Magana, Lakewood, CA (US); Jamie Wagner, Torrance, CA (US)

(72) Inventors: Robert Samuel Simons, Redondo Beach, CA (US); Chadron Michael Magana, Lakewood, CA (US); Jamie Wagner, Torrance, CA (US)

(73) Assignee: EDELBROCK, LLC, Torrance, CA (US)

( * ) Notice: Subject to any disclaimer, the term of this patent is extended or adjusted under 35 U.S.C. 154(b) by 624 days.

(21) Appl. No.: 13/662,088

(22) Filed: Oct. 26, 2012

(65) Prior Publication Data

US 2014/0116397 A1 May 1, 2014

(51) Int. Cl.

| | |
|---|---|
| ***F02M 37/08*** | (2006.01) |
| ***F02M 37/10*** | (2006.01) |
| ***F02M 37/00*** | (2006.01) |
| *F02M 37/18* | (2006.01) |

(52) U.S. Cl.

CPC ..... *F02M 37/10* (2013.01); *F02M 37/0076* (2013.01); *F02M 37/18* (2013.01)

(58) Field of Classification Search

CPC ..... F02M 37/10; F02M 37/18; F02M 37/08; F02M 37/0076

See application file for complete search history.

(56) References Cited

U.S. PATENT DOCUMENTS

| | | | | |
|---|---|---|---|---|
| 2,888,002 | A * | 5/1959 | High | 123/382 |
| 2,896,602 | A * | 7/1959 | Dahl | 123/179.17 |
| 4,539,965 | A | 9/1985 | Soltau | |
| 4,579,093 | A | 4/1986 | Eanes | |
| 4,844,043 | A | 7/1989 | Keller | |
| 4,848,283 | A | 7/1989 | Garms et al. | |
| 5,103,793 | A | 4/1992 | Rese et al. | |
| 5,368,001 | A | 11/1994 | Roche | |
| 5,389,245 | A | 2/1995 | Jaeger et al. | |
| 5,579,740 | A | 12/1996 | Cotton et al. | |
| 5,647,331 | A | 7/1997 | Swanson | |
| 5,855,197 | A | 1/1999 | Kato | |
| 5,865,160 | A | 2/1999 | Kato | |
| 5,873,347 | A | 2/1999 | Kato et al. | |
| 5,908,020 | A | 6/1999 | Boutwell et al. | |
| 6,216,671 | B1 | 4/2001 | Sawert et al. | |
| 6,257,208 | B1 | 7/2001 | Harvey | |
| 6,305,357 | B1 | 10/2001 | Soukeras | |
| 6,311,725 | B1 | 11/2001 | Hamada et al. | |
| 6,314,946 | B1 | 11/2001 | Funakura | |
| 6,345,608 | B1 | 2/2002 | Rembold | |

(Continued)

*Primary Examiner* — Hieu T Vo

(74) *Attorney, Agent, or Firm* — Buchalter Nemer

(57) ABSTRACT

An electronic fuel injection system for land vehicles, comprising: a fuel tank, at least one pump, a fuel sump, wherein the at least one pump is operatively coupled to and between the fuel tank and the sump, and an engine, wherein the engine is operatively coupled to the fuel sump. A fuel sump system for land vehicles, comprising: an inlet from a pump, wherein the pump is operatively connected to a fuel tank, a fuel pump system, a regulator operatively coupled to the fuel pump system, an outlet operatively coupled to an engine, and a float component, coupled to the inlet. An electronic fuel injection system for land vehicles, comprising: a fuel tank, at least one pump, a fuel sump, wherein the at least one pump is operatively coupled to and between the fuel tank and the sump, and an engine, wherein the engine is operatively coupled to the fuel sump and wherein the electronic fuel injection system does not require a return line from the engine to the fuel tank.

17 Claims, 9 Drawing Sheets

(56) References Cited

U.S. PATENT DOCUMENTS

| | | | |
|---|---|---|---|
| 6,405,711 | B1 | 6/2002 | Smith et al. |
| 6,484,342 | B2 | 11/2002 | Takasaki |
| 6,655,366 | B2 | 12/2003 | Sakai |
| 6,679,229 | B2 | 1/2004 | Wada et al. |
| 6,718,953 | B1 | 4/2004 | Torgerud |
| 6,729,308 | B1 | 5/2004 | Kanamaru |
| 6,739,318 | B2 | 5/2004 | Nomura |
| 6,792,918 | B1 | 9/2004 | Halsall |
| 6,802,301 | B2 | 10/2004 | Fauser |
| 6,866,029 | B1 | 3/2005 | Clarkson et al. |
| 6,918,380 | B2 | 7/2005 | Nomura |
| 6,971,374 | B2 | 12/2005 | Saito |
| 7,089,917 | B1 * | 8/2006 | McKinster et al. ..... 123/509 |
| 7,114,491 | B2 | 10/2006 | Hamada et al. |
| 7,117,857 | B2 | 10/2006 | Saito |
| 7,152,583 | B2 | 12/2006 | Abe et al. |
| 7,168,414 | B2 | 1/2007 | Harvey |
| 7,503,314 | B2 | 3/2009 | Achor |
| 7,677,225 | B2 | 3/2010 | Radue |
| 2002/0100457 | A1 | 8/2002 | Sakai |
| 2004/0003796 | A1 | 1/2004 | Nomura |
| 2006/0048757 | A1 | 3/2006 | Harvey |

* cited by examiner

Prior Art Figure 1

Prior Art Figure 2

Prior Art Figure 3

FUEL SYSTEM CONVERSIONS FOR CARBURETOR TO ELECTRONIC FUEL INJECTION SYSTEMS, METHODS OF PRODUCTION THEREOF

FIELD OF THE SUBJECT MATTER

The field of the subject matter is converting the fuel systems for a carburetor to that for an electronic fuel injection system, including the methods of use and production.

BACKGROUND

Fuel injection systems are designed to deliver a mix of air and fuel into the combustion engine. Both carburetors and electronic fuel injection systems have been around quite a while, but carburetors were used early on, because electronic fuel injection technology was not perfected or practical until the mid-1980s.

A typical carburetor fuel system 100 is shown in Prior Art FIG. 1 and comprises a fuel tank 110 that is operatively coupled to a mechanical pump 120, which is operatively coupled to the carburetor 130 in the engine 140. Prior Art FIG. 2 shows an alternate embodiment 200 and comprises a fuel tank 210 that is operatively coupled to a low-pressure electric pump 220, which is operatively coupled to the carburetor 230 in the engine 240. The main issue with obtaining the best performance using a carburetor is that it can't monitor or vary the air to fuel ratio to account for different operating or atmospheric conditions. So, the best fuel to air ratio for the engine, becomes a compromise.

The Electronic Fuel Injection system or EFI is utilized to better control fuel to air ratios in order to provide better performance. Prior Art FIG. 3 shows a typical electronic fuel injection conversion fuel system 300 that comprises a fuel tank 310, a high-pressure electric pump 320 that is operatively coupled to the fuel tank 310 that directs fuel into the engine 330. A return line 340 comprising a pressure regulator 345 is directed back to the fuel tank 310. In this embodiment, the fuel tank 310 is adapted/retrofitted to add at least one baffle 315 that is required to prevent fuel sloshing. One of the disadvantages to these conventional EFI systems is that if fuel sloshes around, "fuel starvation" can occur, which is where the fuel-pick up line (not shown) loses connection/contact with the fuel. Unlike a carburetor that has an on-board fuel reserve in its bowl, the EFI arrangement can starve of fuel, as mentioned, if there is a low amount of fuel or if the fuel is sloshing around.

Another key difference between an electronic fuel injection system and a carburetor system is that the electronic system comprises a high pressure electronic pump, as opposed to the carburetor system that utilizes a low pressure pump system. So, in many instances, if one was going to convert from a conventional carburetor system to a conventional EFI system, the low pressure pumps in the carburetor system would need to be replaced by a high pressure pump, along with adding return lines to and baffles in the fuel tank.

To this end, it would be desirable to produce a fuel system for an electronic fuel injection system that achieves at least one of the following goals: a) simplifies the overall electronic fuel system arrangement, b) provides a modified system that ensures fuel is always delivered to the engine on demand, c) can be included in an original land vehicle system or may be provided in a conversion kit for existing land vehicle systems without requiring extensive modifications, and d) doesn't require a return line in the fuel injection system.

SUMMARY OF THE SUBJECT MATTER

An electronic fuel injection system for land vehicles, comprising: a fuel tank, at least one pump, a fuel sump, wherein the at least one pump is operatively coupled to and between the fuel tank and the sump, and an engine, wherein the engine is operatively coupled to the fuel sump.

A fuel sump system for land vehicles, comprising: an inlet from a pump, wherein the pump is operatively connected to a fuel tank, a fuel pump system, within the sump, a regulator operatively coupled to the fuel pump system, also contained within the sump, an outlet operatively coupled to an engine, and a float component, coupled to the sump inlet.

An electronic fuel injection system for land vehicles, comprising: a fuel tank, at least one pump, a fuel sump, wherein the at least one pump is operatively coupled to and between the fuel tank and the sump, and an engine, wherein the engine is operatively coupled to the fuel sump and wherein the electronic fuel injection system does not require a return line from the engine to the fuel tank.

DETAILED DESCRIPTION

A fuel system for an electronic fuel injection system has been developed that achieves at least one of the following goals: a) simplifies the overall electronic fuel system arrangement, b) provides a modified system that ensures fuel is always delivered to the engine on demand, c) can be included in an original land vehicle system or may be provided in a conversion kit for existing land vehicle systems without requiring extensive modifications, and d) doesn't require a return line in the fuel injection system. As used herein, the phrase "operatively coupled" or "operatively connected" are designed to be used interchangeably and to mean that two or more parts, components, lines or combinations thereof are connected together or coupled in such a way that they operate together or for the mechanical benefit of one another.

Figure 1:
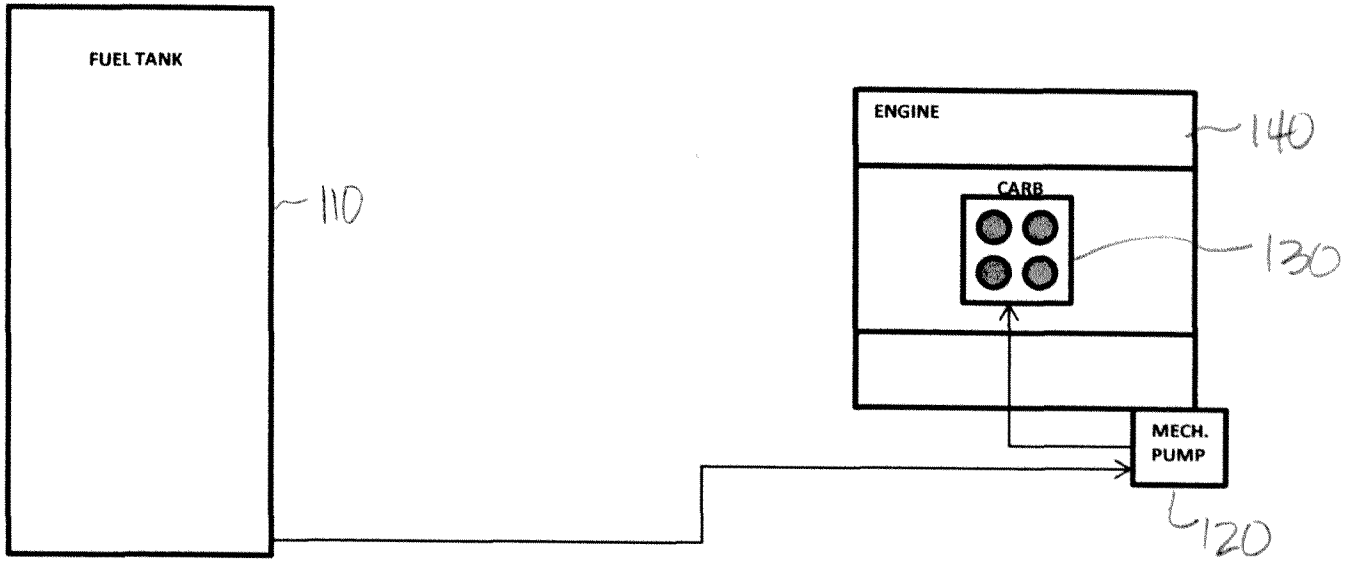
FIG. 1 shows a prior art carburetor fuel system.
Figure 2:
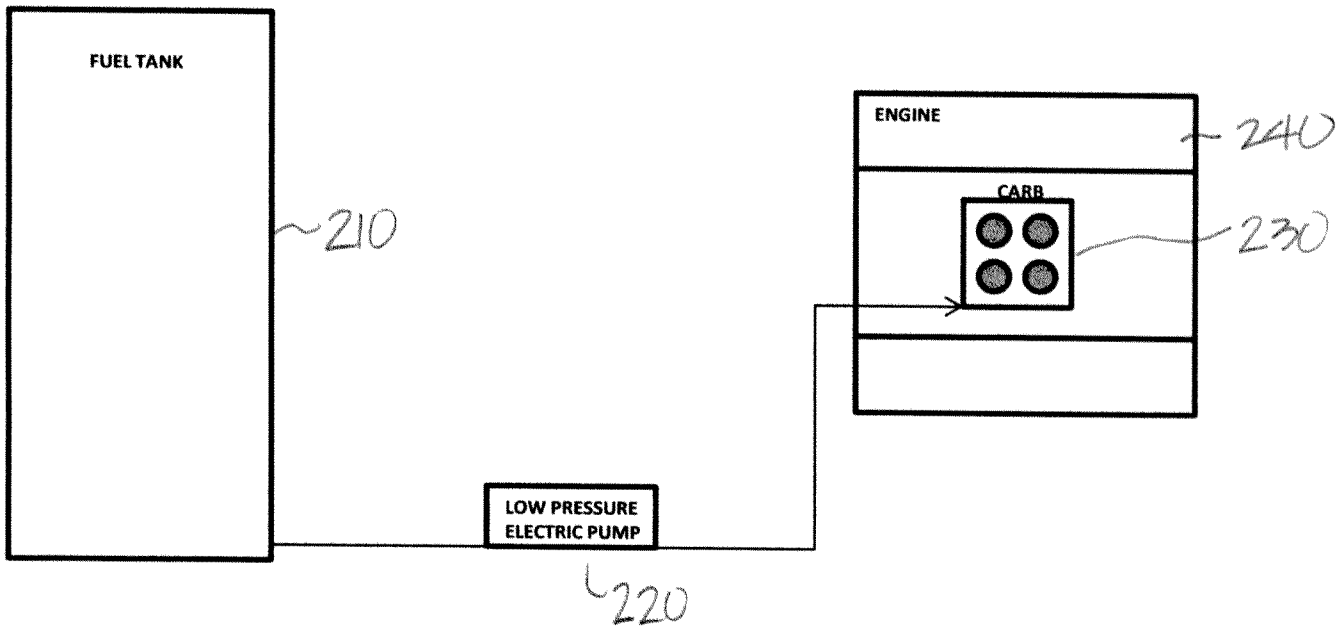
FIG. 2 shows a prior art carburetor fuel system.
Figure 3:
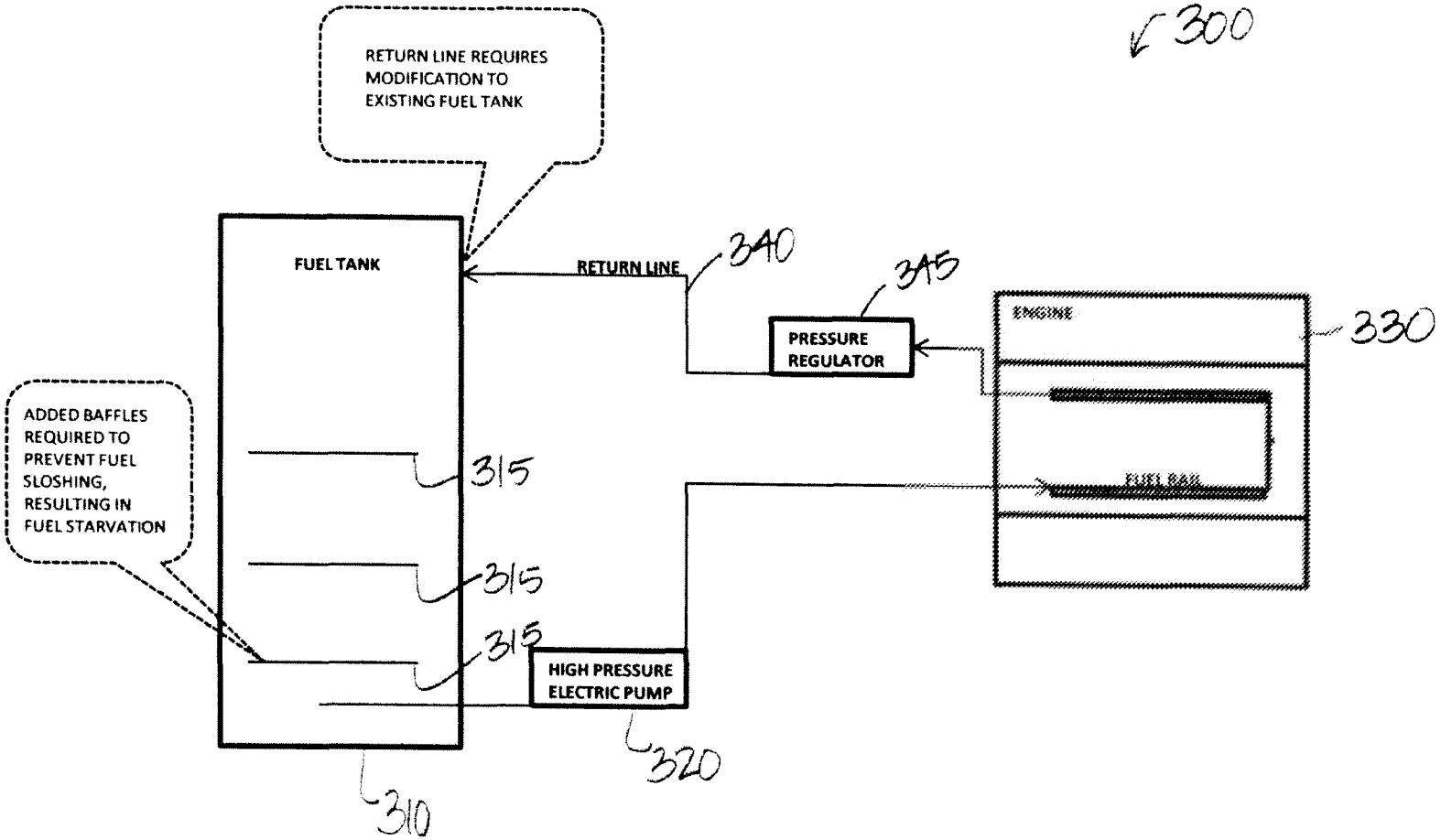
FIG. 3 shows a prior art electronic fuel injection conversion fuel system.
Figure 4:
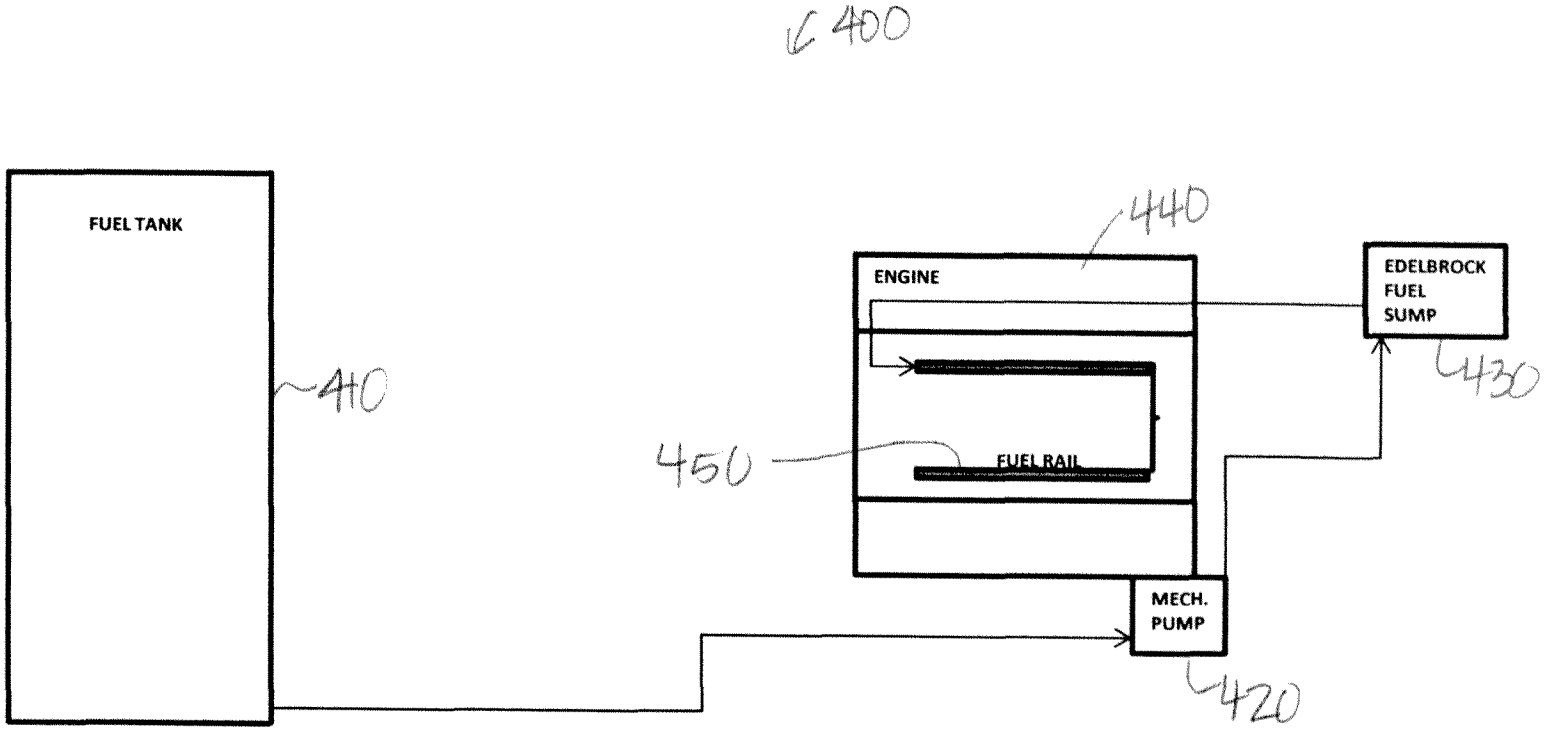
FIG. 4 shows a contemplated electronic fuel injection system.

Specifically, and as shown in FIG. 4, an electronic fuel injection system 400 for land vehicles (not shown) has been developed and comprises: a fuel tank 410, at least one pump 420, a fuel sump 430, wherein the at least one pump is operatively coupled to and between the fuel tank and the sump, and an engine 440, wherein the engine is operatively coupled to the fuel sump. In some embodiments, the engine will comprise a fuel rail 450, which is shown in this Figure. In contemplated embodiments, the at least one pump may be a low pressure pump, a high pressure pump or a combination thereof. In other contemplated embodiments, the at least one pump is the original pump that was provided in the land vehicle before the addition of the fuel sump.

Figure 5:
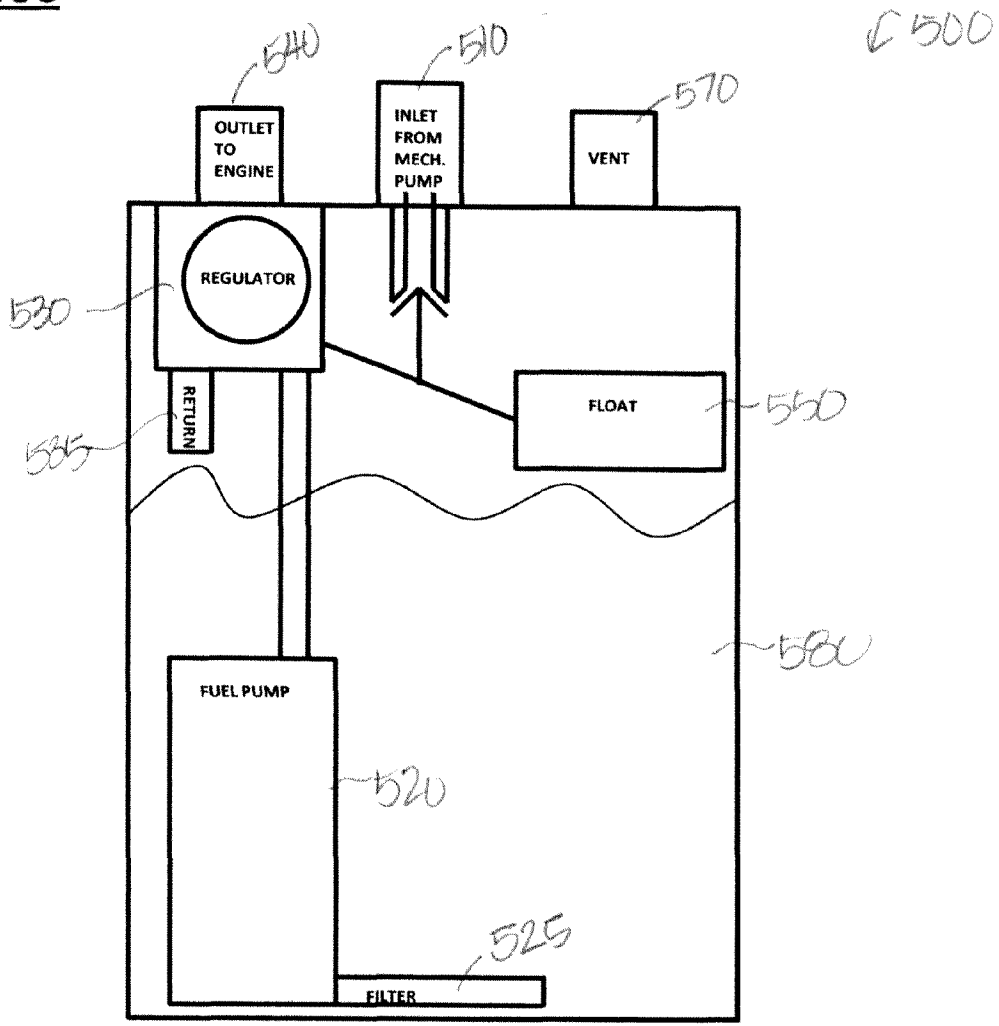
FIG. 5 shows a contemplated fuel sump for a contemplated electronic fuel injection system.

A fuel sump system 500 for land vehicles (not shown) has also been developed, and is shown in FIG. 5, that comprises: an inlet from a pump 510, wherein the pump is operatively connected to a fuel tank (not shown), a fuel pump system 520, a regulator 530 having a return 535 and operatively coupled to the fuel pump system 520, an outlet 540 operatively coupled to an engine (not shown) and a vent 570, and a float component 550, coupled to the inlet 510. Fuel 580 is also shown in this embodiment. Contemplated fuel pump systems comprise a high-pressure electric fuel pump with a filter 525 attached. This arrangement is beneficial for several reasons, as outlined earlier: a) contemplated fuel sump systems may be plugged into an existing carburetor system without changing the low pressure pump provided with the carburetor system, and b) contemplated fuel sump systems don't need a return line to the engine, because of the inclusion of the high pressure fuel pump in the sump system. Contemplated regulators are designed to feed the fuel rail that is part of the engine component. Fuel floats ensure that the sump never overfills. In contemplated embodiments, sumps have a narrow profile design that are designed to eliminate the possibility of sloshing, thereby preventing any fuel starvation, which as discussed herein are common disadvantages to electronic fuel injection design arrangements.

Figure 6:
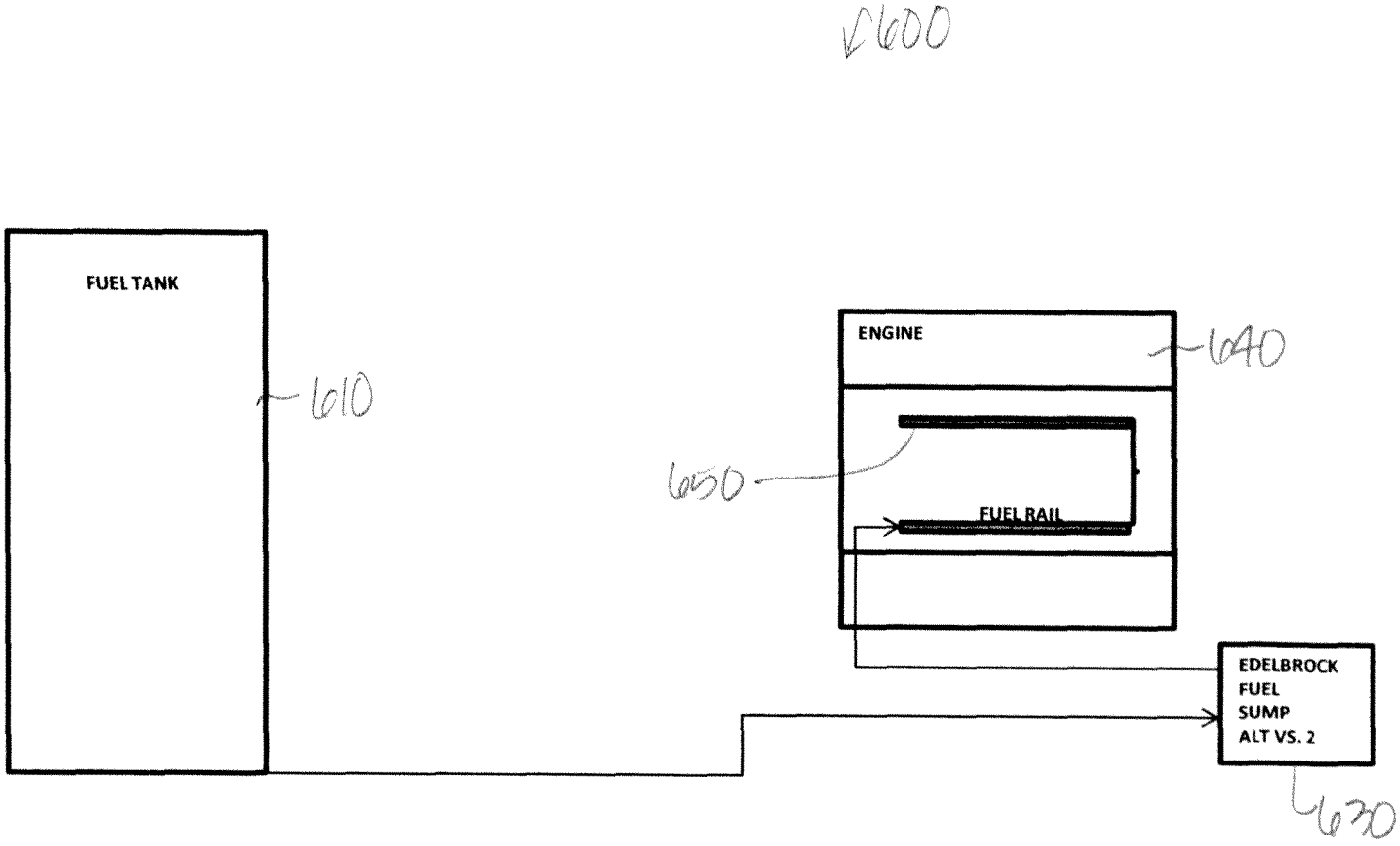
FIG. 6 shows a contemplated electronic fuel injection system.

Specifically, and as shown in FIG. 6, an electronic fuel injection system 600 for land vehicles (not shown) has been developed and comprises: a fuel tank 610, a fuel sump 630, and an engine 640, wherein the engine is operatively coupled to the fuel sump. In some embodiments, the engine will comprise a fuel rail 650, which is shown in this Figure. In this contemplated embodiment, the sump can be easily mounted under the hood of the land vehicle (not shown) and pulls fuel into itself by utilizing an auxiliary internal pump (not shown in this Figure). In this embodiment, the sump also comprises a primary, high pressure, electric fuel pump and a built-in regulator that feed the fuel rail 650. No return line is necessary, because the sump's built-in regulator bleeds off extra pressure internally in the sump tank. Fuel floats and level sensors ensure that the sump never over-fills, and the sump's narrow profile eliminates the possibility of sloshing, thereby preventing any fuel starvation, which is common to EFI conversion set-ups/arrangements.

Figure 7:
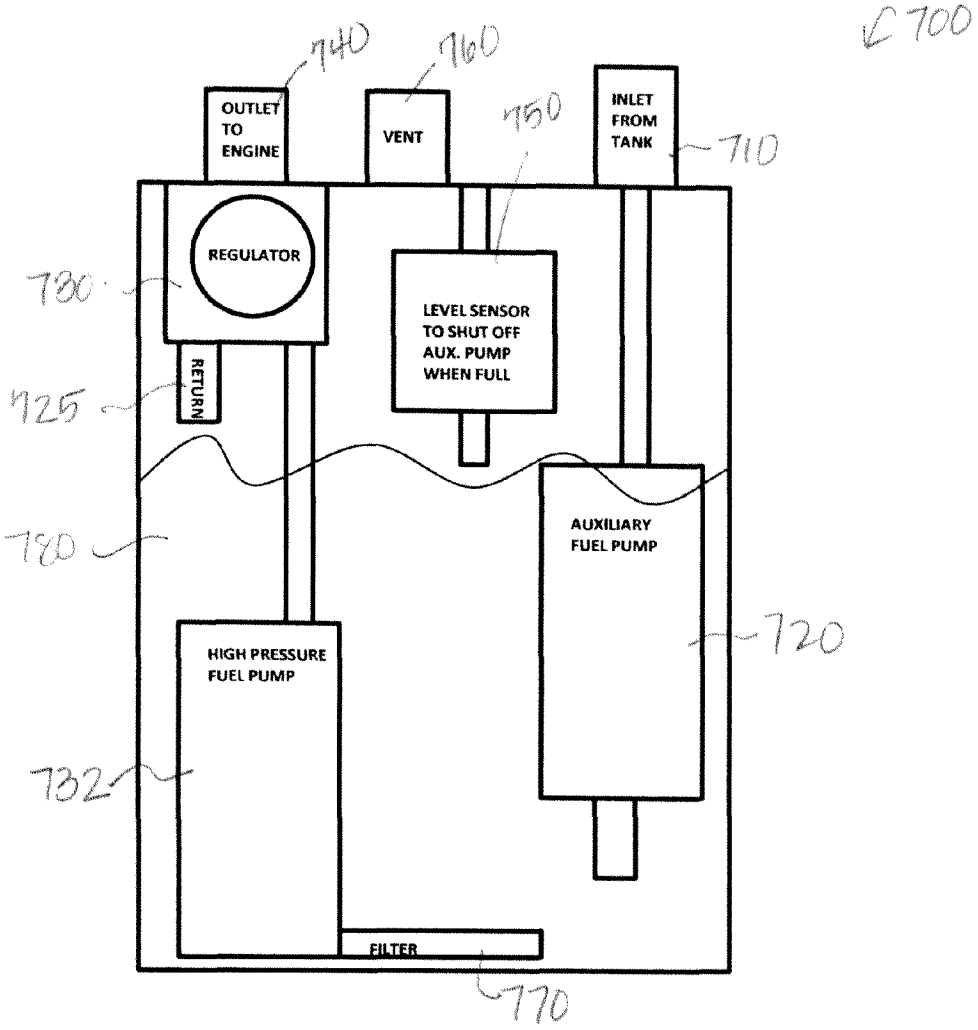
FIG. 7 shows a contemplated fuel sump for a contemplated electronic fuel injection system.

A fuel sump system 700 for land vehicles (not shown) has also been developed, and is shown in FIG. 7, that comprises: an inlet 710 from a fuel tank (not shown), an auxiliary fuel pump system 720, a regulator 730 operatively coupled to the high pressure fuel pump system 732 and a return 725, an outlet 740 operatively coupled to an engine (not shown), and a level sensor component 750 along with a vent 760. Contemplated fuel pump systems comprise a high-pressure electric fuel pump 732 with a filter 770 attached. Fuel 780 is shown in this arrangement. This arrangement is beneficial for several reasons, as outlined earlier: a) contemplated fuel sump systems may be plugged into an existing carburetor system without changing the low pressure pump provided with the carburetor system, and b) contemplated fuel sump systems don't need a return line to the engine, because of the inclusion of the high pressure fuel pump in the sump system. In contemplated embodiments, sumps have a narrow profile design that are designed to eliminate the possibility of sloshing, thereby preventing any fuel starvation, which as discussed herein are common disadvantages to electronic fuel injection design arrangements.

Figure 8:
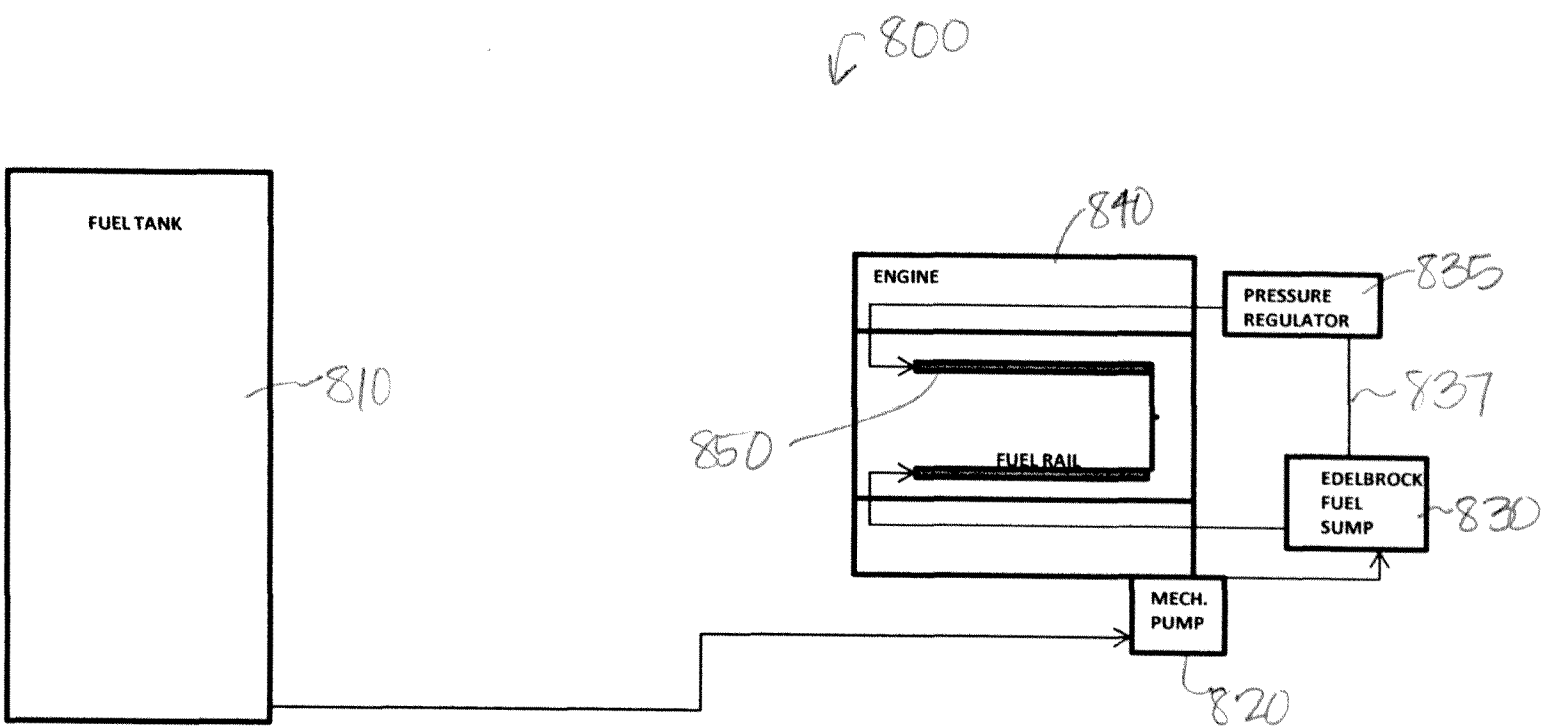
FIG. 8 shows a contemplated electronic fuel injection system.

Specifically, and as shown in FIG. 8, an electronic fuel injection system 800 for land vehicles (not shown) has been developed and comprises: a fuel tank 810, at least one pump 820, a fuel sump 830, wherein the at least one pump is operatively coupled to and between the fuel tank and the sump, a pressure regulator 835 and an engine 840, wherein the engine is operatively coupled to both the fuel sump and the pressure regulator 835. In some embodiments, the engine will comprise a fuel rail 850, which is shown in this Figure. In contemplated embodiments, the at least one pump may be a low pressure pump, a high pressure pump or a combination thereof. In other contemplated embodiments, the at least one pump is the original pump that was provided in the land vehicle before the addition of the fuel sump. In this embodiment, a return line and regulator 835 is used to keep a consistent pressure at the fuel rail 850. The regulator bleeds fuel back to the sump, via the return line 837. The regulator may either be a fixed or adjustable type of regulator.

Figure 9:
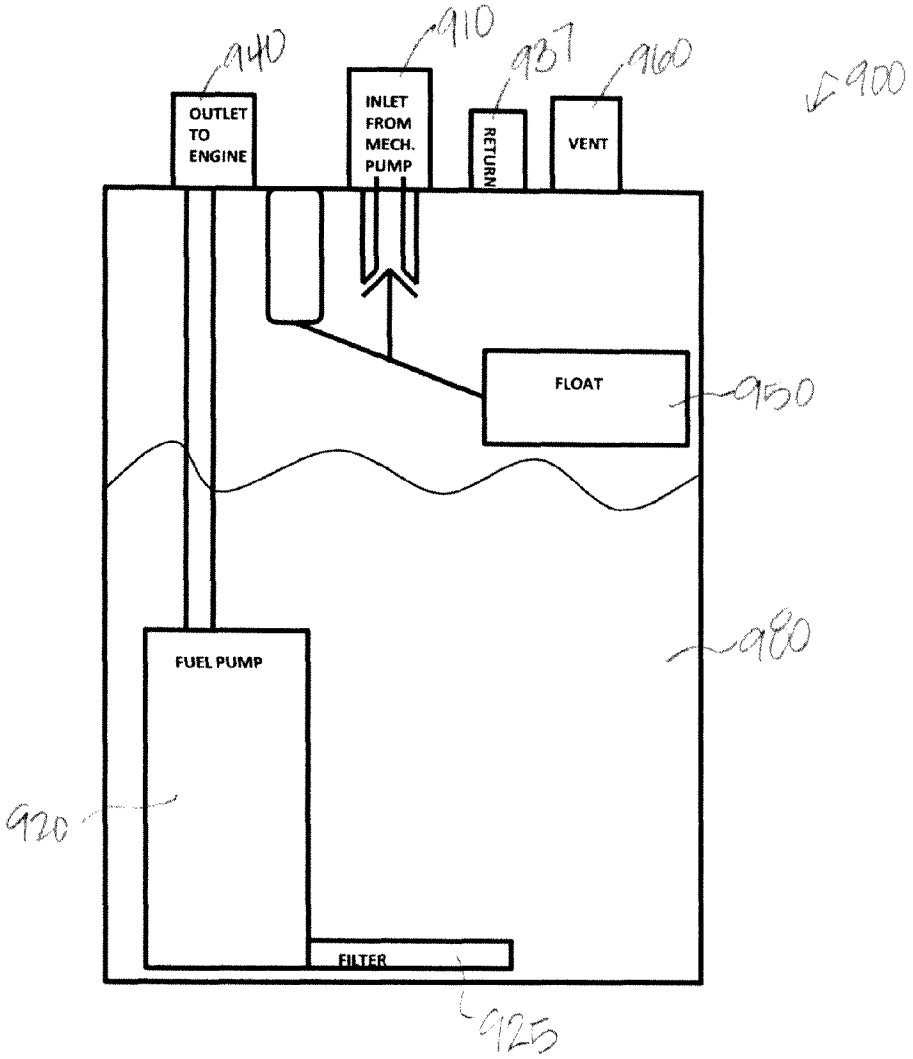
FIG. 9 shows a contemplated fuel sump for a contemplated electronic fuel injection system.

A fuel sump system 900 for land vehicles (not shown) has also been developed, and is shown in FIG. 9, that comprises: an inlet from a pump 910, wherein the pump is operatively connected to a fuel tank (not shown), a fuel pump system 920 and a filter 925, an outlet 940 operatively coupled to an engine (not shown), and a float component 950, coupled to the inlet 910. This contemplated system also comprises a vent 960 and return 937. Fuel floats ensure that the sump never overfills. Fuel 980 is also shown in this embodiment. In contemplated embodiments, sumps have a narrow profile design that are designed to eliminate the possibility of sloshing, thereby preventing any fuel starvation, which as discussed herein are common disadvantages to electronic fuel injection design arrangements.

An electronic fuel injection system for land vehicles, comprising: a fuel tank, at least one pump, a fuel sump, wherein the at least one pump is operatively coupled to and between the fuel tank and the sump, and an engine, wherein the engine is operatively coupled to the fuel sump and wherein the electronic fuel injection system does not require a return line from the engine to the fuel tank. No return line is necessary because the sump's built-in regulator bleeds off extra pressure internally in the sump tank.

For contemplated embodiments utilizing a conversion kit, the existing mechanical or electric low pressure pump that feeds the carburetor can be used to feed the sump. These contemplated sumps are easily mounted under the hood of the land vehicle.

Each of the contemplated components may be formed from any suitable material. Suitable materials are those designed to withstand reasonable wear and tear, as used, especially in combination with pressure differences, temperature differences, fuel mixtures, air mixtures and turbulence.

Thus, specific embodiments, methods of conversions of fuel systems, including the methods of use and production have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the specification and claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

We claim:

1. An electronic fuel injection system for land vehicles, comprising:

a fuel tank;

at least one pump;

a fuel sump, wherein the at least one pump is operatively coupled to and between the fuel tank and the sump, wherein the fuel sump comprises:

an inlet from at least one pump, wherein the pump is operatively connected to a fuel tank, a fuel pump system, a regulator operatively coupled to the fuel pump system, an outlet operatively coupled to an engine, and a float component, coupled to the inlet; and an engine, wherein the engine is operatively coupled to the fuel sump.

2. The electronic fuel injection system for land vehicles of claim 1, wherein the fuel pump system further comprises a filter component.

3. The electronic fuel injection system for land vehicles of claim 1, wherein the regulator further comprises a return component.

4. The electronic fuel injection system for land vehicles of claim 1, wherein the fuel pump system comprises a high pressure pump.

5. An electronic fuel injection system for land vehicles, comprising:

a fuel tank;

at least one pump, wherein the pump comprises a mechanical pump, an electric pump, a low-pressure pump or a combination thereof;

a fuel sump, wherein the at least one pump is operatively coupled to and between the fuel tank and the sump; and an engine, wherein the engine is operatively coupled to the fuel sump.

6. A fuel sump system for land vehicles, comprising:

an inlet from a pump, wherein the pump is operatively connected to a fuel tank, a fuel pump system, a regulator operatively coupled to the fuel pump system, an outlet operatively coupled to an engine, and a float component, coupled to the inlet.

7. The fuel sump system of claim 6, wherein the fuel pump system comprises a high pressure pump.

8. The fuel sump system of claim 6, wherein the fuel pump system further comprises a filter component.

9. The fuel sump system of claim 6, wherein the regulator further comprises a return component.

10. An electronic fuel injection system for land vehicles, comprising:

a fuel tank, at least one pump, a fuel sump, wherein the at least one pump is operatively coupled to and between the fuel tank and the sump, and an engine, wherein the engine is operatively coupled to the fuel sump and wherein the electronic fuel injection system does not require a return line from the engine to the fuel tank.

11. The electronic fuel injection system for land vehicles of claim 10, wherein the fuel sump comprises:

an inlet from at least one pump, wherein the pump is operatively connected to a fuel tank, a fuel pump system, a regulator operatively coupled to the fuel pump system, an outlet operatively coupled to an engine, and a float component, coupled to the inlet.

12. The electronic fuel injection system for land vehicles of claim 11, wherein the fuel pump system further comprises a filter component.

13. The electronic fuel injection system for land vehicles of claim 11, wherein the regulator further comprises a return component.

14. The electronic fuel injection system for land vehicles of claim 10, wherein the pump comprises a mechanical pump, an electric pump, a low-pressure pump or a combination thereof.

15. The electronic fuel injection system of claim 10, wherein the fuel pump system comprises a high pressure pump.

16. The electronic fuel injection system of claim 10, wherein the fuel pump system further comprises a filter component.

17. The electronic fuel injection system of claim 10, wherein the regulator further comprises a return component.

* * * * *